US010934709B2

(12) United States Patent
Puppi et al.

(10) Patent No.: US 10,934,709 B2
(45) Date of Patent: Mar. 2, 2021

(54) PREFABRICATED SELF-SUPPORTING MODULE FOR MAKING BUILDING STRUCTURES, MORE PARTICULARLY SWIMMING POOLS

(71) Applicant: PREFORMATI ITALIA SRL UNIPERSONALE, Mussolente (IT)

(72) Inventors: Enrico Giovanni Puppi, Cassola (IT); Andrea Zanon, Mussolente (IT)

(73) Assignee: PREFORMATI ITALIA SRL UNIPERSONALE, Mussolente (IT)

( * ) Notice: Subject to any disclaimer, the term of this patent is extended or adjusted under 35 U.S.C. 154(b) by 0 days.

(21) Appl. No.: 16/610,498

(22) PCT Filed: May 3, 2018

(86) PCT No.: PCT/IB2018/053071

§ 371 (c)(1),
(2) Date: Nov. 2, 2019

(87) PCT Pub. No.: WO2018/203269

PCT Pub. Date: Nov. 8, 2018

(65) Prior Publication Data

US 2020/0157811 A1 May 21, 2020

(30) Foreign Application Priority Data

May 3, 2017 (IT) ..... 102017000047564

(51) Int. Cl.
*E04C 2/22* (2006.01)
*E04C 2/20* (2006.01)
(Continued)

(52) U.S. Cl.
CPC ..... *E04C 2/205* (2013.01); *E04B 1/14* (2013.01); *E04B 1/34853* (2013.01);
(Continued)

(58) Field of Classification Search
CPC ..... E04C 2/205; E04B 1/14; E04B 1/34853; E04B 2001/2481; E04H 4/0031; E04H 4/005; E04H 2004/0068
See application file for complete search history.

(56) References Cited

U.S. PATENT DOCUMENTS 3,782,049 A 1/1974 Sachs
4,532,745 A * 8/1985 Kinard ..... E04B 2/8629 52/251

(Continued)

FOREIGN PATENT DOCUMENTS

FR 3030599 A1 6/2016
IT VE20090027 A1 11/2010

*Primary Examiner* — Patrick J Maestri
(74) *Attorney, Agent, or Firm* — Howson & Howson LLP

(57) ABSTRACT

A prefabricated self-supporting module for making building structures, more particularly swimming pools, is provided. The module comprises a matrix made of foamed material and a supporting structure made of metal coupled to the matrix. The supporting structure made of metal may be embedded in the matrix made of foamed material (internal supporting structure) and/or cover the matrix made of foamed material (external supporting structure). Thanks to the provision of the supporting structure made of metal, the module is self-supporting, and it does not need any further reinforcements of reinforced concrete. Thanks to the provision of the supporting structure made of metal, the module can be used for making structural supporting elements such as floors, side walls, and so on. This module can be completely made and finished in the factory, so that the steps to be carried out on the construction site are extremely limited, with consequent economic saving.

16 Claims, 4 Drawing Sheets

(51) Int. Cl.

| | |
|---|---|
| ***E04B 1/14*** | (2006.01) |
| *E04B 1/348* | (2006.01) |
| *E04B 1/24* | (2006.01) |
| *E04H 4/00* | (2006.01) |

(52) U.S. Cl.
CPC ..... *E04B 2001/2481* (2013.01); *E04H 4/005* (2013.01); *E04H 4/0031* (2013.01); *E04H 2004/0068* (2013.01)

(56) References Cited

U.S. PATENT DOCUMENTS

| | | | | |
|---|---|---|---|---|
| 5,921,046 | A | 7/1999 | Hammond, Jr. | |
| 6,385,942 | B1 * | 5/2002 | Grossman ..... | E04B 1/14 52/630 |
| 2010/0307089 | A1 | 12/2010 | Cox | |

* cited by examiner

PREFABRICATED SELF-SUPPORTING MODULE FOR MAKING BUILDING STRUCTURES, MORE PARTICULARLY SWIMMING POOLS

TECHNICAL FIELD OF THE INVENTION

The present invention refers to a prefabricated self-supporting module for making building structures.

More particularly, the present invention refers to a prefabricated self-supporting module for making swimming pools.

PRIOR ART

Using panels made of foamed material for making swimming pool walls is known from the state of the art. Although on one hand these panels have the advantage of having a low weight and being very easy to be handled, on the other hand it is to be considered that the foamed material has a very low mechanical strength.

Consequently, the foamed material is typically used for making hollow blocks, which are open at the their top and bottom as well as at their sides ("formwork blocks") and which, once placed side to side and stacked on one another, form a formwork intended to be filled with reinforced concrete, which is the actual supporting element of the structure.

In order to obtain such a formwork it is necessary to use a number of blocks of foamed material which, although depending on the size of the swimming pool to be built, is in any case high; in addition, each block has to be carefully aligned with the adjacent ones. As a result, the step of positioning said blocks of foamed material—which has to be carried out directly on the construction site—is laborious and takes much time.

Once the blocks have been positioned, a metal reinforcement is inserted and then the bocks are filled with the concrete. The steps of positioning the metal reinforcement and filling the blocks (which have to be carried out on the construction site as well) are also time consuming and laborious. Furthermore, the amount of concrete required is large, which significantly affects the production costs of the swimming pool.

Once the supporting structure has been completed, it is then necessary to prepare said structure for receiving the necessary electrical and hydraulic accessories, as well as the connections of said accessories to the outside. This further contributes to lengthen the working time on the construction site, impose the need for the presence of a large number of skilled workers on the construction site and, ultimately, increase the production costs of the swimming pool.

In order to limit the disadvantages discussed above, in the past prefabricated panels for making building structures, more particularly swimming pools, were developed.

Indeed, Italian patent IT 1395680 discloses a panel made of foamed material which is made solid (rather than hollow), with the exception of vertical through-channels, which extend from the upper edge to the lower edge of the panel and which are intended to be filled with reinforced concrete. The aforementioned panels made of foamed material can be already made with proper size in the factory, before arriving on site. On the construction site a supporting layer is realized (at ground level in the case of above-ground swimming pools or at the bottom of the containment groundwork in the case of underground swimming pools), on which layer reinforcing rods are fixed, and the panels of foamed material are placed on the supporting layer by inserting the reinforcing rods into the through-channels of said panels. Said through-channels are successively filled with concrete.

Substantially similar solutions are disclosed in documents U.S. Pat. Nos. 3,782,049 and 5,921,046.

Also the structures disclosed in these documents provide for the use of panels made of foamed material which comprise channels, inside which reinforcing rods can be made to pass and which can be filled with concrete. The use of such panels allows to reduce the number of components and thus to make their positioning easier. Moreover, it allows to significantly reduce the amount of used concrete. Consequently, the use of said panels entails a reduction in the working time on site and a reduction of the production costs of a swimming pool or, more generally, of a building structure.

However, this solution cannot in any case be considered as optimal.

In fact, due to the low structural strength of the foamed material, the number of preparatory steps that can be carried out in the factory—before laying the panels on the construction site and adding the concrete—is however limited.

Still due to the low structural strength of the foamed material, the size of the individual panels has to be limited in order to avoid the risk of breakage and damage, which sets a severe limitation to the possibility of reducing the number of components necessary for making the swimming pool.

Moreover, the use of concrete (although in limited amounts) for filling the channels of the panels made of foamed material, entails in any case the need to provide means for the production of said concrete on the construction site (or, alternatively, the need to provide for the use of truckconcrete mixers for transporting the concrete to the construction site) and entails a limitation to the reduction of the working time on the construction site, since, after the concrete has been poured into the channels of the aforesaid panels, it is necessary to wait for it to harden.

The main object of the present invention is therefore to overcome the limitations of the prior art and, more particularly, to minimize the working times on the construction site for making building structures, more particularly swimming pools.

Another object of the present invention is to make the making of building structures, more particularly swimming pools, easier and to reduce the production costs thereof.

These and other objects are achieved by the prefabricated self-supporting module as claimed in the appended claims.

SUMMARY OF THE INVENTION

The module according to the invention advantageously comprises a matrix made of foamed material and a supporting structure made of metal and coupled to said matrix.

Said supporting structure made of metal may be embedded in the matrix made of foamed material (internal supporting structure) and/or cover said matrix made of foamed material (external supporting structure).

Said supporting structure made of metal is preferably made of steel, more preferably of stainless steel or of steel with an anti-corrosion treatment (galvanizing, varnishing, and the like). However, other metals (e.g. aluminum) could also be used.

Thanks to the provision of the supporting structure made of metal, the module according to the invention is self-supporting and it does not need further reinforcements of reinforced concrete.

Thanks to the provision of the supporting structure made of metal, the module according to the invention can be used for making structural supporting elements such as floors, side walls, ceilings.

Still thanks to the provision of the supporting structure made of metal, the module according to the invention can have a considerable size, much larger than those of the known panels made of foamed material, without this entailing risks of breakage and damage.

Not only is the module according to the invention made in the factory, but said module can also be pre-arranged to receive all the electrical and hydraulic accessories and the corresponding connections before leaving the factory. In the case of swimming pools, the shaving and waterproofing of the module can also take place in the factory. Consequently, the steps to be carried out on the construction site are extremely limited and essentially consist in laying the modules according to the invention, connecting said modules for obtaining the selected building structure and aligning said modules with one another and with the surrounding external structures (for instance with the bottom of the containment groundwork in the case of underground swimming pools).

The above obviously allows to minimize the working time on the construction site, with consequent economic saving.

BRIEF DESCRIPTION OF THE DRAWINGS

Further features and advantages of the invention will become clear from the following description of a preferred embodiment thereof, given by way of non-limiting example, with reference to the attached drawings, in which.

DETAILED DESCRIPTION OF PREFERRED EMBODIMENTS OF THE INVENTION

Figure 1:
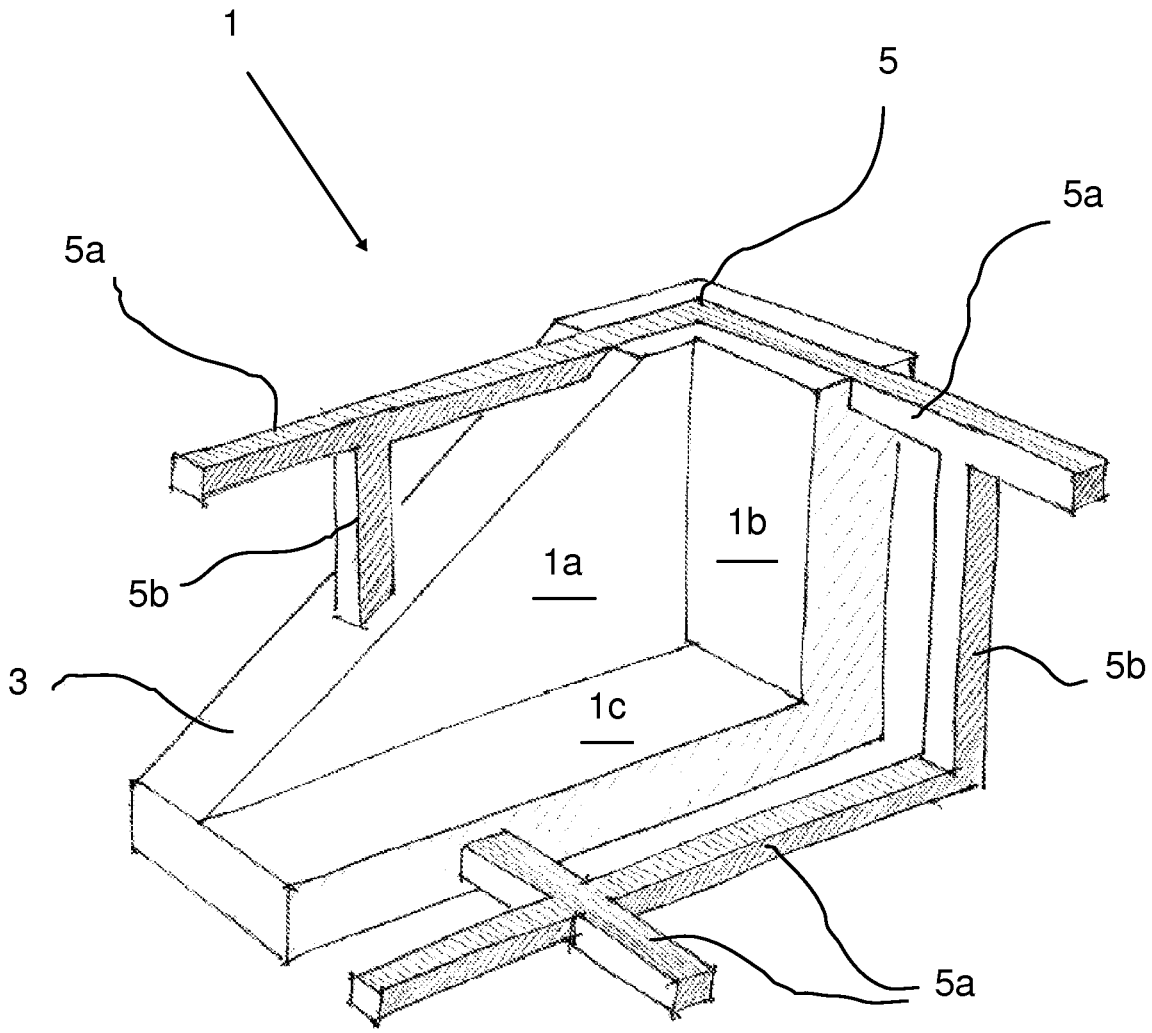
FIG. 1 is a schematic axonometric view, partially broken away, of a prefabricated self-supporting module according to a first embodiment of the invention.

With reference to FIG. 1, a prefabricated self-supporting module according to the invention, denoted as a whole by reference 1, is schematically shown. According to its more general features, the module 1 comprises a matrix made of foamed material 3 and a supporting structure made of metal 5 coupled to said matrix. Herein, foamed material means a material having a density lower than 0.1 kg/m$^3$, more particularly a polymeric material having a density lower than 0.1 kg/dm$^3$. Expanded polystyrene foam (EPS) and extruded polystyrene foam (XPS) may be advantageously used for making the matrix 3. The supporting structure 5 is preferably made of steel, more preferably made of stainless steel or steel with an anti-corrosion treatment (galvanizing, varnishing, and the like). However, other metals (e.g. aluminum) could also be used.

Said supporting structure 5 can be an internal supporting structure, as in the example illustrated in FIG. 1: in this case the supporting structure made of metal 5 includes a plurality of beams 5*a* and/or uprights 5*b* embedded in the matrix made of foamed material 3. In this respect, it is evident that the supporting elements 5*a*, 5*b* of the supporting structure 5 do not necessarily have to be arranged horizontally or vertically, but they could also be differently oriented. Furthermore, they do not necessarily have to be straight.

In addition or as an alternative to said beams and uprights, the supporting structure 5 could include elements made of metal which partially or completely cover the surface of the matrix made of foamed material 3 (external supporting structure).

It is evident from FIG. 1 that the module 1 is intrinsically self-supporting and that the use of concrete is not necessary.

It is also evident from FIG. 1 that—thanks to the provision of the supporting structure made of metal 5—it is possible to use the module according to the invention for making structural elements such as floors, side walls and the like, as well as complex elements as in the example shown in FIG. 1, wherein the module 1 is a corner element of a building structure, comprising a first side wall portion 1*a*, a second side wall portion 1*b* orthogonal to said first portion, and a floor portion 1*c* orthogonal to both side wall portions 1*a*, 1*b*.

It should be noted in this connection that, although in the example shown in FIG. 1 the walls 1*a*, 1*b* and 1*c* are flat and orthogonal to each other, such configuration is in no way to be understood in a limiting sense. The walls of the module 1 according to the invention could also be inclined with respect to one another by an angle other than 90°. Furthermore, according to the invention it is also possible to make modules comprising one or more curved walls.

Finally, it is evident that the modules 1 according to the invention can be completely made inside the production factory and that the only steps to be carried out on the construction site are laying said modules and connecting them to form the desired building structure.

Figure 2:
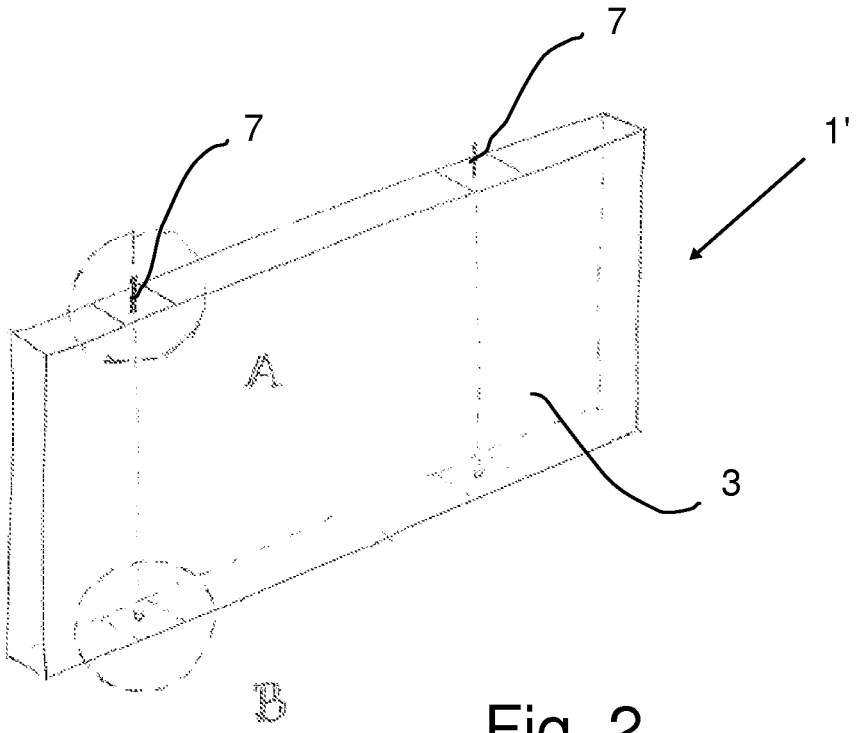
FIG. 2 is a schematic perspective view of an example of a prefabricated self-supporting module according to a second embodiment of the invention.
Figure 3:
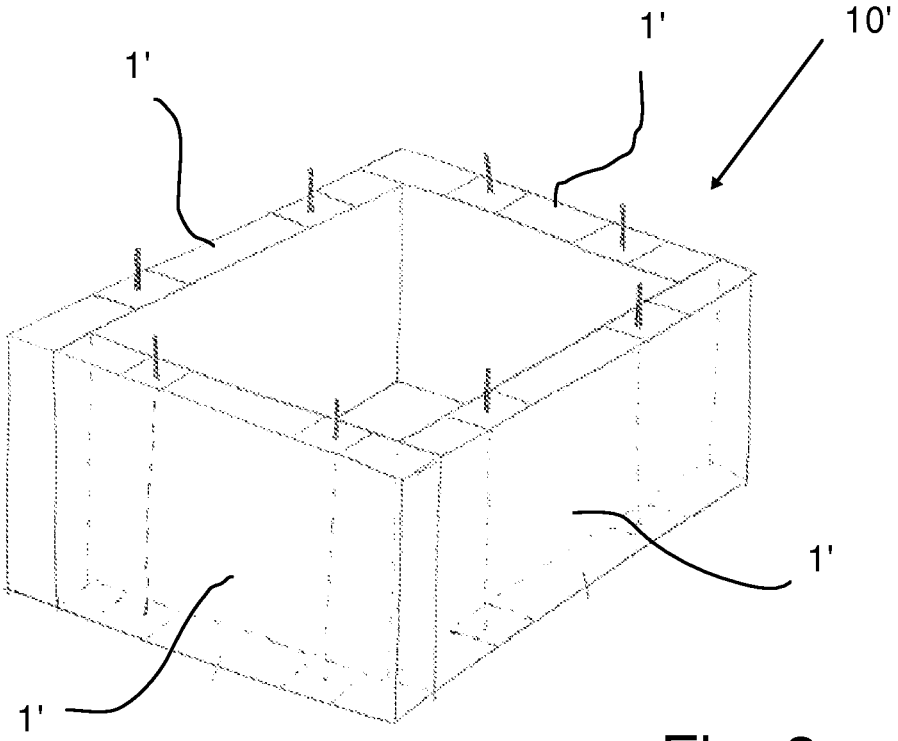
FIG. 3 is a schematic perspective view of a building structure comprising a plurality of prefabricated self-supporting modules of FIG. 2.

In this respect, FIG. 2 shows an example of a module 1' according to a second embodiment of the invention, in which said module 1' forms a side wall portion of a building structure and in FIG. 3 a building structure, namely a swimming pool 10', obtained by connecting together four modules 1' is schematically illustrated.

Said modules 1' can be connected to each other and to the floor of the structure by means of any suitable technique known to the person skilled in the art, for example by gluing or by using dowels. Preferably, said connection mainly occurs at the supporting structure 5.

It should be noted that, thanks to the provision of the supporting structure made of metal, the modules 1' can have a considerable size; for example, they can have a length of more than 4-5 meters, which allows—as in the case of FIG. 3—to use only one module 1' for each side wall of the swimming pool 10'.

In this second embodiment, the modules 1' according to the invention are advantageously provided with a levelling system which allows to align each module with the adjacent modules and with the surrounding external structures.

Figure 4:
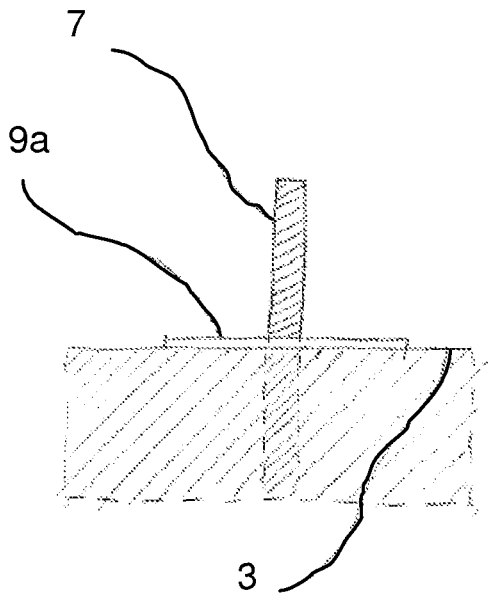
FIG. 4 is a cross-sectional view of the detail A of FIG. 2.
Figure 5:
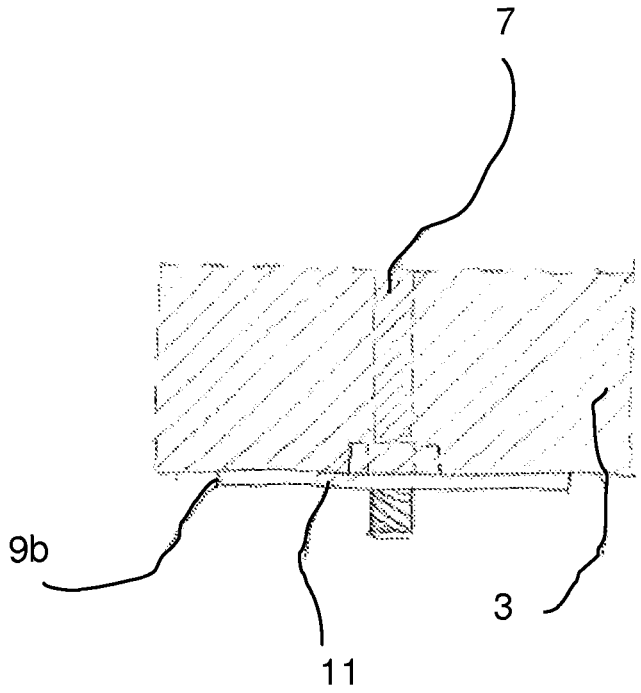
FIG. 5 is a cross-sectional view of the detail B of FIG. 2.

As more clearly seen in FIGS. 4 and 5, said system comprises a plurality of threaded bars 7, which are vertically arranged through the module 1', from the upper edge to the lower edge of said module. Each threaded bar passes through an upper metallic bored plate 9*a*, which is glued or otherwise fixed on the upper edge of the module 1', and through a lower metallic bored plate 9*b*, which is glued or otherwise fastened beneath the lower edge of the module 1'. An internally threaded nut 11 is welded to one of said two plates (to the lower plate 9*b* in the example shown in the Figures).

Since the nut 11 is integral with the plate and, therefore, with the module 1', turning the threaded bar 7 from its upper end in a clockwise or counterclockwise direction will result in a raising or, respectively, a lowering of the corresponding portion of the module 1' relative to the bar itself.

In order to obtain the levelling of the module 1', it will therefore be sufficient to appropriately rotate each threaded bar 7 provided in the module 1'.

In the example shown in the Figures, the threaded bars 7 are inserted into the matrix made of foamed material 3. However, in an alternative embodiment of the invention, they could also be connected to uprights of the supporting structure made of metal.

Figure 6:
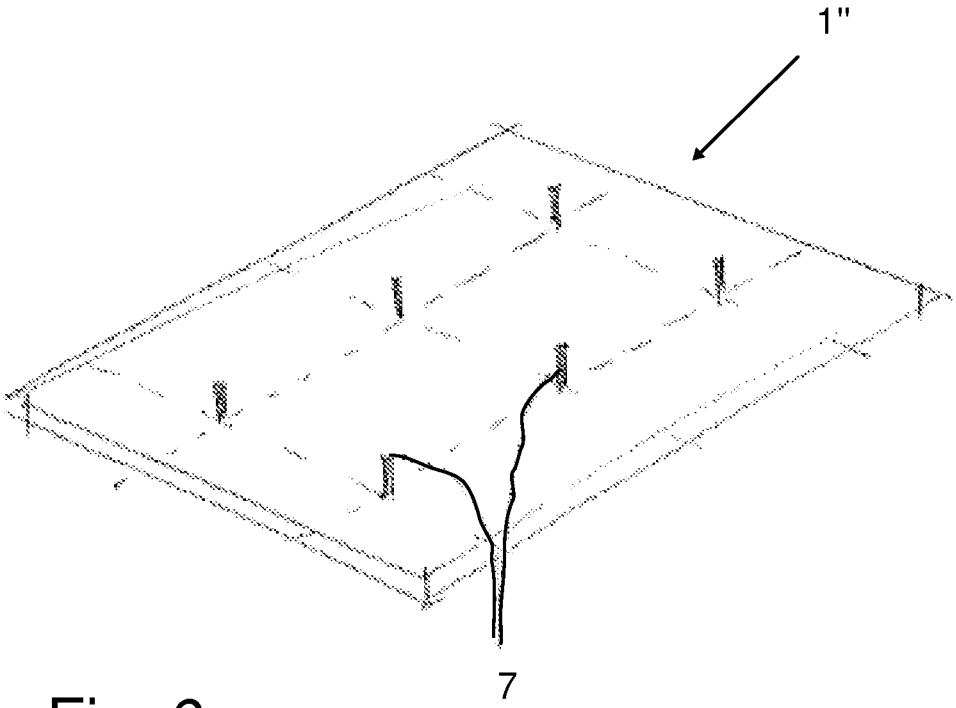
FIG. 6 is a schematic perspective view of another example of a prefabricated self-supporting module according to the second embodiment of the invention.
Figure 7:
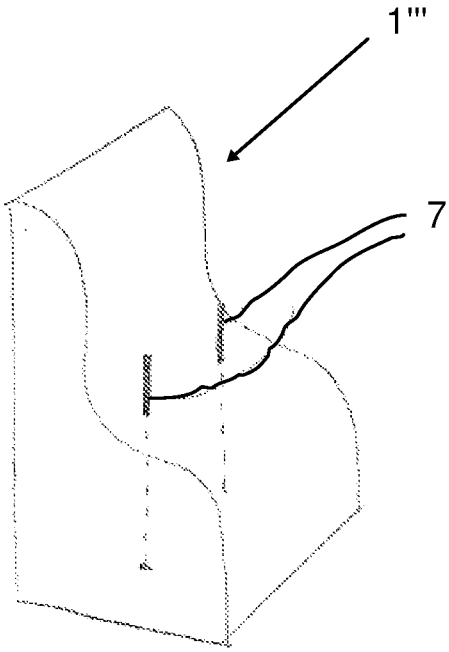
FIG. 7 is a schematic perspective view of a further example of a prefabricated self-supporting module according to the second embodiment of the invention.

The aforesaid levelling arrangement can also be used when the module according to the invention is used for making floor elements (as in the case of the module 1" of FIG. 6) and when the module according to the invention is used for making secondary structures (as in the case of the module 1'" shaped like a seat of FIG. 7).

From the above disclosure, it will be evident to the person skilled in the art that the prefabricated self-supporting module according to the invention allows to achieve the objects set forth above, as it completely eliminates the need to use concrete and minimizes the steps to be carried out on the construction site.

It will also be evident to the person skilled in the art that the detailed description given herein of a preferred embodiment of the invention has been provided merely by way of example and many variations and modifications are possible without departing from the scope of protection as defined by the appended claims.

The invention claimed is:

1. A prefabricated self-supporting module for making swimming pools, comprising:

a matrix made of foamed material and a supporting structure made of metal and coupled to the matrix;

wherein the supporting structure made of metal is provided inside the matrix made of foamed material and comprises a plurality of beams, uprights, or supporting elements embedded directly in the foamed material of the matrix;

wherein the prefabricated self-supporting module comprises a first side wall portion, a second side wall portion, which is orthogonal to the first side wall portion, and a floor portion, which is orthogonal to both the first and the second side wall portions, and wherein beams, uprights or supporting elements of the first side wall portion, beams, uprights or supporting elements of the second side wall portion and beams, uprights or supporting elements of the floor portion are connected to each other.

2. The prefabricated self-supporting module according to claim 1, wherein the module is provided with a levelling system allowing to level each module to adjacent modules as well as to surrounding outer structures.

3. The prefabricated self-supporting module according to claim 2, wherein each module has an upper edge and a lower edge and wherein the levelling system comprises one or more threaded bars which are vertically arranged through the module, from the upper edge of the module to the lower edge of the module, each of the threaded bars being engaged in an internally threaded nut which is integral to the module.

4. The prefabricated self-supporting module according to claim 3, wherein each of the threaded bars passes through a respective upper metallic bored plate arranged on the upper edge of the module and through a lower metallic bored plate fastened beneath the lower edge of the module and wherein the nut is welded to one of the two upper and lower plates.

5. The prefabricated self-supporting module according to claim 3, wherein the threaded bars are inserted in the matrix made of foamed material.

6. The prefabricated self-supporting module according to claim 3, wherein the threaded bars are connected to the supporting structure made of metal.

7. The prefabricated self-supporting module according to claim 1, wherein the matrix made of foamed material is made of a material selected from the group consisting of expanded polystyrene foam (EPS) and extruded polystyrene foam (XPS).

8. The prefabricated self-supporting module according to claim 1, wherein the supporting structure made of metal is made of steel.

9. The prefabricated self-supporting module according to claim 1, wherein the beams, uprights or supporting elements of the first side wall portion, the beams, uprights or supporting elements of the second side wall portion and the beams, uprights or supporting elements of the floor portion are made as a single piece, whereby the supporting structure is an integral one-piece supporting structure.

10. A prefabricated self-supporting module for making building structures, comprising:

a matrix made of foamed material and a supporting structure made of metal and coupled to the matrix;

wherein the supporting structure made of metal is provided inside the matrix made of foamed material and comprises a plurality of beams, uprights, or supporting elements embedded directly in the foamed material of the matrix; and wherein the module is provided with a levelling system allowing to level each module to adjacent modules as well as to surrounding outer structures.

11. The prefabricated self-supporting module according to claim 10, wherein each module has an upper edge and a lower edge and wherein the levelling system comprises one or more threaded bars which are vertically arranged through the module, from the upper edge of the module to the lower edge of the module, each of the threaded bars being engaged in an internally threaded nut which is integral to the module.

12. The prefabricated self-supporting module according to claim 11, wherein each of the threaded bars passes through a respective upper metallic bored plate arranged on the upper edge of the module and through a lower metallic bored plate fastened beneath the lower edge of the module and wherein the nut is welded to one of the two upper and lower plates.

13. The prefabricated self-supporting module according to claim 11, wherein the threaded bars are inserted in the matrix made of foamed material.

14. The prefabricated self-supporting module according to claim 11, wherein the threaded bars are connected to the supporting structure made of metal.

15. The prefabricated self-supporting module according to claim 10, wherein the matrix made of foamed material is made of a material selected from the group consisting of expanded polystyrene foam (EPS) and extruded polystyrene foam (XPS).

16. The prefabricated self-supporting module according to claim 10, wherein the supporting structure made of metal is made of steel.

* * * * *